US012539005B2

(12) United States Patent
Morphey et al.

(10) Patent No.: US 12,539,005 B2
(45) Date of Patent: Feb. 3, 2026

(54) CORD SAVER RIB

(71) Applicant: Techtronic Floor Care Technology Limited, Tortola (VG)

(72) Inventors: John Morphey, Concord, NC (US); Gregory J. Kowalski, Cornelius, NC (US)

(73) Assignee: Techtronic Floor Care Technology Limited, Tortola (VG)

( * ) Notice: Subject to any disclaimer, the term of this patent is extended or adjusted under 35 U.S.C. 154(b) by 0 days.

(21) Appl. No.: 19/108,953

(22) PCT Filed: Sep. 21, 2023

(86) PCT No.: PCT/US2023/074733
§ 371 (c)(1),
(2) Date: Mar. 5, 2025

(87) PCT Pub. No.: WO2024/064786
PCT Pub. Date: Mar. 28, 2024

(65) Prior Publication Data

US 2025/0261812 A1 Aug. 21, 2025

Related U.S. Application Data

(60) Provisional application No. 63/376,877, filed on Sep. 23, 2022.

(51) Int. Cl.
*A47L 9/04* (2006.01)

(52) U.S. Cl.
CPC ..... *A47L 9/0477* (2013.01); *A47L 9/0444* (2013.01)

(58) Field of Classification Search
CPC ..... A47L 9/02; A47L 9/0626; A47L 9/248; A47L 9/0477; A47L 9/066; A47L 9/0488;
(Continued)

(56) References Cited

U.S. PATENT DOCUMENTS 6,161,251 A 12/2000 Lee et al.
6,799,351 B2 10/2004 Porath
(Continued)

FOREIGN PATENT DOCUMENTS

EP 3326504 A1 5/2018
GB 2489626 A 10/2012
WO 2011111884 A1 9/2011

OTHER PUBLICATIONS

International Search Report and Written Opinion for Application No. PCT/US2023/074733 dated Jan. 29, 2024 (12 pages).

*Primary Examiner* — Monica S Carter
*Assistant Examiner* — Sharonda T Felton
(74) *Attorney, Agent, or Firm* — Michael Best & Friedrich LLP

(57) ABSTRACT

A vacuum cleaner including a surface cleaning head having a brushroll rotatable about an axis defining an axial direction, and a brushroll housing at least partially surrounding the brushroll. The brushroll housing includes an outlet port disposed at a first axial location, and a bottom housing. The bottom housing includes a front wall, a rear wall spaced from the front wall to define the suction inlet, and at least one rib disposed below the brushroll and extending across the suction inlet between the front and rear walls. Each rib includes a forward portion connected to the front wall, a rearward portion connected to the rear wall, and a central portion extending linearly orthogonal to the axial direction between the forward and rearward portions. The rearward portion is turned toward the first axial location of the outlet port to define a flow guide.

23 Claims, 7 Drawing Sheets

(58) Field of Classification Search
CPC ..... A47L 5/30; A47L 5/362; A47L 7/0066; A47L 2201/00; A46B 3/005
See application file for complete search history.

(56) References Cited

U.S. PATENT DOCUMENTS

| | | | | |
|---|---|---|---|---|
| 8,214,967 | B2 | 7/2012 | Knox et al. | |
| 8,347,456 | B2 | 1/2013 | Sweeby et al. | |
| 8,418,313 | B1 | 4/2013 | Miner et al. | |
| 8,474,094 | B2 | 7/2013 | Maguire et al. | |
| 8,528,158 | B2 | 9/2013 | Maguire et al. | |
| 8,555,462 | B2 | 10/2013 | Maguire et al. | |
| 8,832,902 | B2 | 9/2014 | Kim et al. | |
| 9,144,356 | B2 | 9/2015 | Yun | |
| 10,130,225 | B2 | 11/2018 | Yun | |
| 10,251,520 | B2 | 4/2019 | Jeong et al. | |
| 10,542,857 | B2 | 1/2020 | Yun | |
| 10,588,472 | B2 | 3/2020 | Choi et al. | |
| 2003/0145423 | A1 | 8/2003 | Park et al. | |
| 2004/0244140 | A1 | 12/2004 | Joo | |
| 2005/0217068 | A1 | 10/2005 | Kim et al. | |
| 2010/0257680 | A1* | 10/2010 | Maguire | A47L 9/0477 15/21.1 |
| 2014/0259475 | A1* | 9/2014 | Doughty | A47L 11/282 15/207.2 |
| 2015/0374187 | A1 | 12/2015 | Denhof | |
| 2020/0121144 | A1* | 4/2020 | Gacin | A47L 9/0613 |

* cited by examiner

CORD SAVER RIB

CROSS-REFERENCE TO RELATED APPLICATIONS

This application claims priority to U.S. Provisional Patent Application No. 63/376,877, filed Sep. 23, 2022, the entire contents of which are hereby incorporated by reference herein.

TECHNOLOGICAL FIELD

The present disclosure relates to a cord saver rib of a brushroll housing on a surface cleaning head for a vacuum cleaner.

SUMMARY

In one embodiment, the disclosure provides a vacuum cleaner including a suction motor operable to move working air through a working air flow path from a suction inlet to a clean air outlet, a dirt separator located along the working air flow path to separate dirt from the working air, and a surface cleaning head. The surface cleaning head includes a brushroll rotatable about an axis defining an axial direction, and a brushroll housing at least partially surrounding the brushroll. The brushroll housing includes an outlet port disposed at a first axial location of the brushroll housing, and a bottom housing provided on the bottom of the brushroll housing. The bottom housing includes a front wall, a rear wall spaced from the front wall to define the suction inlet, and at least one rib disposed below the brushroll and extending across the suction inlet between the front and rear walls. Each rib includes a forward portion connected to the front wall, a rearward portion connected to the rear wall, and a central portion extending orthogonal to the axial direction between the forward and rearward portions. The rearward portion is turned toward the first axial location of the outlet port to define a flow guide.

Another embodiment of the disclosure provides a vacuum cleaner including a surface cleaning head with a brushroll and a brushroll housing. A bottom housing of the brushroll housing includes first and second ribs disposed below the brushroll and extending across the suction inlet between the front and rear walls. Each of the first and second ribs includes a forward portion connected to the front wall, a rearward portion connected to the rear wall, and a central portion extending orthogonal to the axial direction between the forward and rearward portions. The rearward portion is turned toward the first axial location of the outlet port to define a flow guide. The first rib is located on a first axial side of the first axial location and the second rib located on a second axial side of the first axial location.

In another embodiment, the disclosure provides a surface cleaning head with a brushroll and a brushroll housing. A bottom housing of the brushroll housing includes a plurality of ribs disposed below the brushroll. Each rib of the plurality of ribs includes a central portion extending orthogonal to the axis across a suction inlet between the front wall and the rear wall, and a flow guide to direct working air toward the first axial location of the outlet port.

Other aspects of the disclosure will become apparent by consideration of the detailed description and accompanying drawings.

DETAILED DESCRIPTION

Before any embodiments are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

Figure 1:
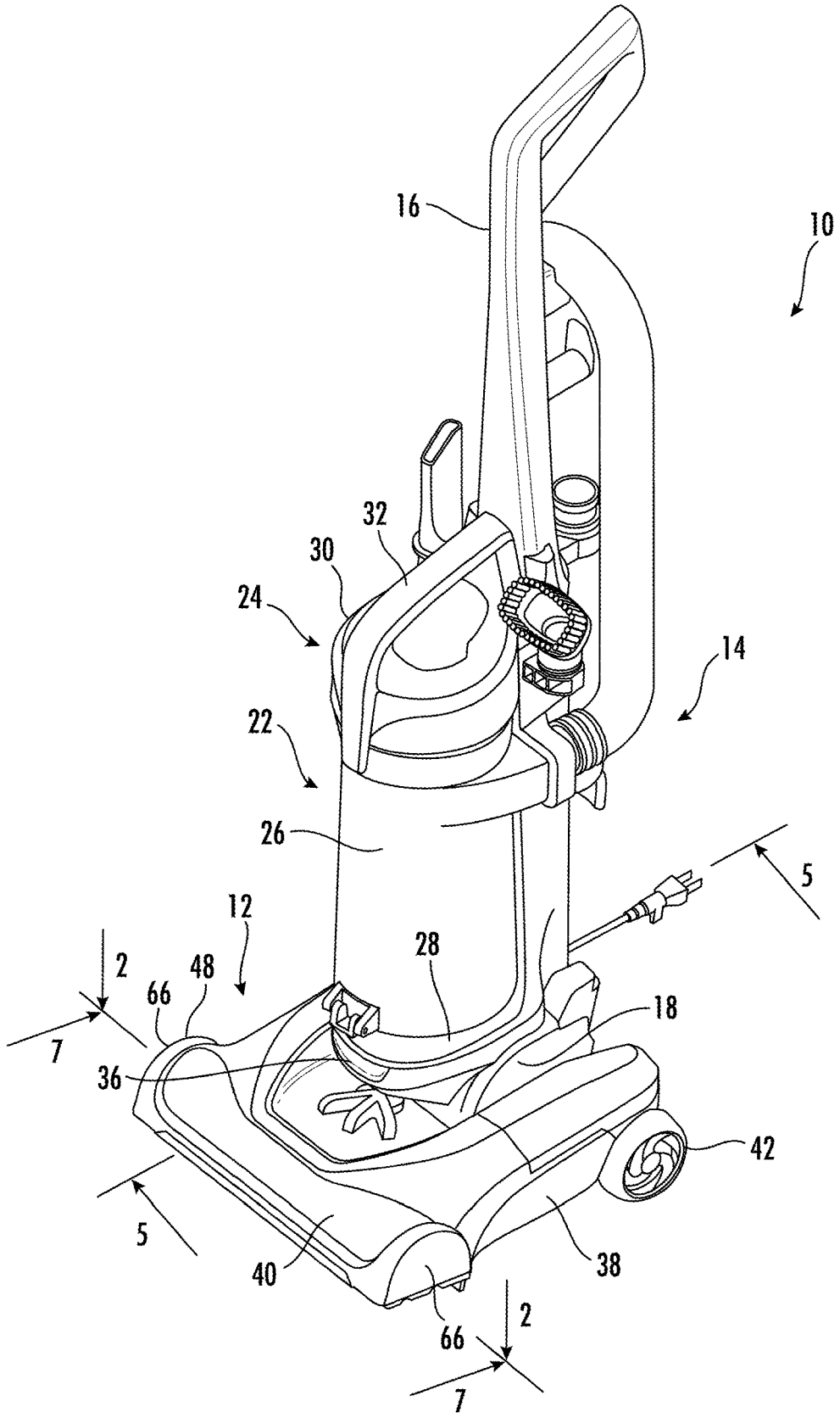
FIG. 1 is a perspective view of a vacuum cleaner of an embodiment of the disclosure.

FIG. 1 illustrates a vacuum cleaner 10 according to one embodiment. The vacuum cleaner 10 includes a surface cleaning head 12 and an upper body 14 pivotally connected to the rear end of the surface cleaning head 12 for pivoting between an upright stowed position and a lowered in-use position. The upper body 14 includes a handle 16 to be gripped by an operator for moving the vacuum cleaner 10 across a surface to be cleaned. The illustrated vacuum cleaner 10 is an upright style vacuum cleaner. Other embodiments of the vacuum cleaner 10 could also include a canister style cleaner, a central vacuum system, a hard floor wet cleaner, a carpet extractor, a pole vacuum, a stick vacuum, or a handheld vacuum.

The upper body 14 also includes a suction motor (not shown) positioned within a motor housing 18 at the base of the upper body 18. The suction motor is oriented such that an axis of rotation 20 of the motor shaft (not shown) is horizontal. The suction motor operates to move working air through a working air flow path from a suction inlet 34 to a clean air outlet 36. The upper body also includes a dirt separator 22 located along the working air flow path to separate dirt and debris from the working air. The dirt separator 22 includes a dirt cup 24 removable from the upper body 14 for emptying. The dirt cup 24 includes a cylindrical wall 26, a pivoting bottom door 28, and an openable cover 30 having a carry handle 32. The dirt cup 24 includes a cyclonic dirt separator (not shown) within the cylindrical wall 26. The cyclonic dirt separator may include a single stage cyclone, a dual stage cyclone arrangement, or a multi-cyclone arrangement having a second stage with a plurality of cyclones in parallel. The dirt separator 22 may also include a filter bag or other non-cyclonic dirt separator.

Figure 2:
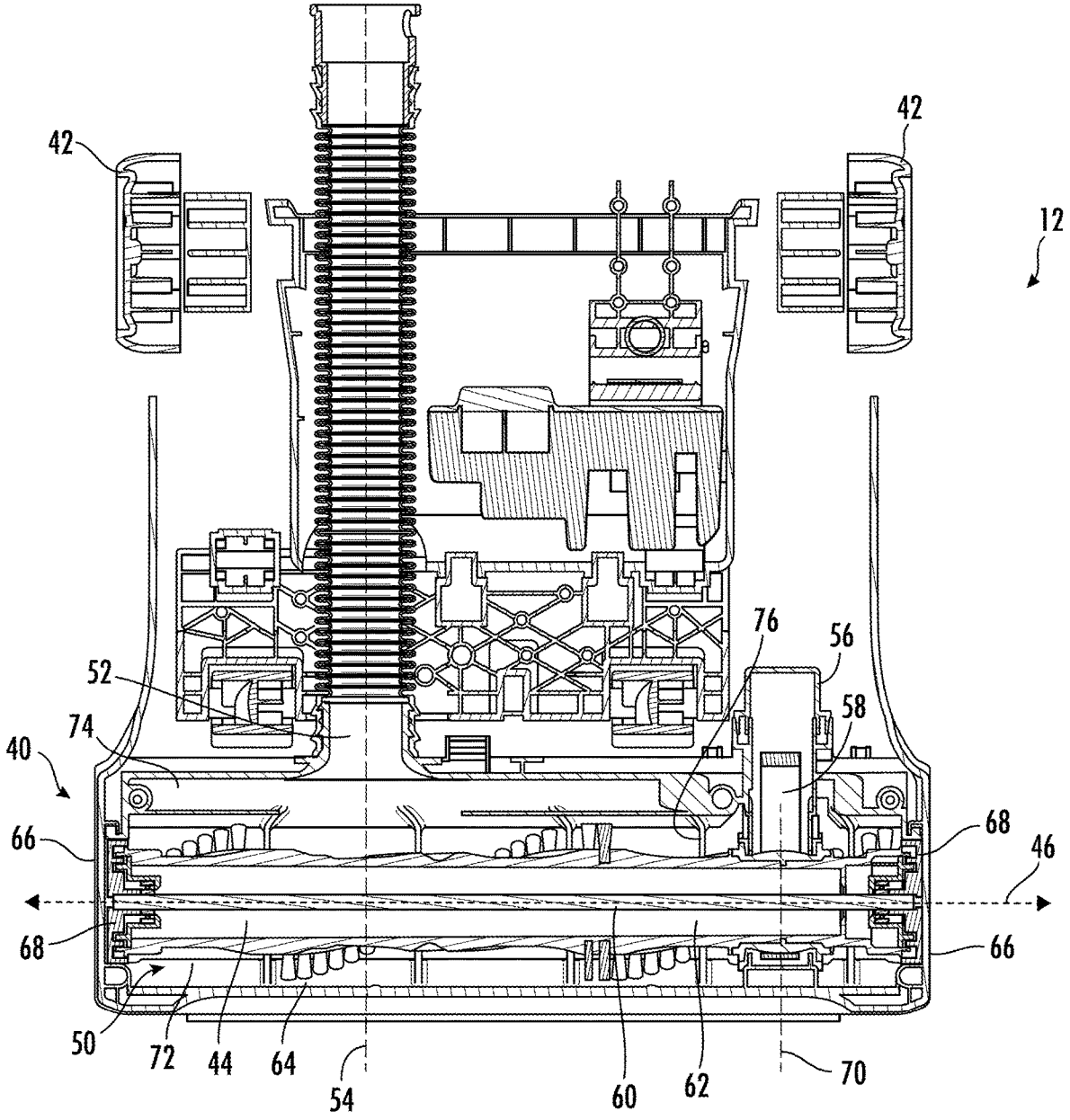
FIG. 2 is a cross-section view taken along line 2-2 of FIG. 1.

With further reference to FIG. 2, the surface cleaning head 12 includes a body 38, a brushroll housing 40 at the front of the body 12, and wheels 42 rotatably mounted at the rear of the body 38. The surface cleaning head 12 also includes a brushroll 44 mounted for rotation about a brushroll axis 46 within the brushroll housing 40, which substantially surrounds the brushroll 44. The brushroll axis 46 defines an axial direction. The brushroll housing 40 includes a top housing 48 defining an upper portion of the brushroll housing 40 and a bottom housing 50 defining a lower portion of the brushroll housing 40. The top housing 50 includes an outlet port 52 upstream along the working air flow path from the dirt separator 22 and suction motor. The outlet port 52 is located at a first axial location 54 along the brushroll axis 46. The outlet port 52 is located offset from the axial center of the surface cleaning head 12, however the outlet port 52 could be located at any axial position along the brushroll housing 40. Although the illustrated surface cleaning head 12 is a main surface cleaning head of illustrated vacuum cleaner 10, the surface cleaning head 12 could instead be an auxiliary surface cleaning head such as an accessory tool attachable to a vacuum cleaner hose for above floor cleaning.

The surface cleaning head 12 also includes a belt guard 56 extending between the back of the body 38 to the brushroll housing 40 and a belt 58 coupling the motor shaft and the brushroll 44 such that when the suction motor is turned on, the motor shaft will rotate to drive the belt 58 to in turn rotate the brushroll 44. The belt 58 and belt guard 56 are located at a second axial position 70 spaced from the first axial position 54 of the outlet port 52. The surface cleaning head 12 may also include a brushroll shutoff mechanism to alternately couple and decouple the belt connection via a tensioner between the motor shaft and the brushroll to, for example, create slack in the belt 58 to stop the rotation of the brushroll 44 when the upper body 14 is in the upright position. The brushroll shutoff mechanism can be manually actuated or automatic based on the position of the upper body 14 relative to the surface cleaning head 12.

Figure 5:
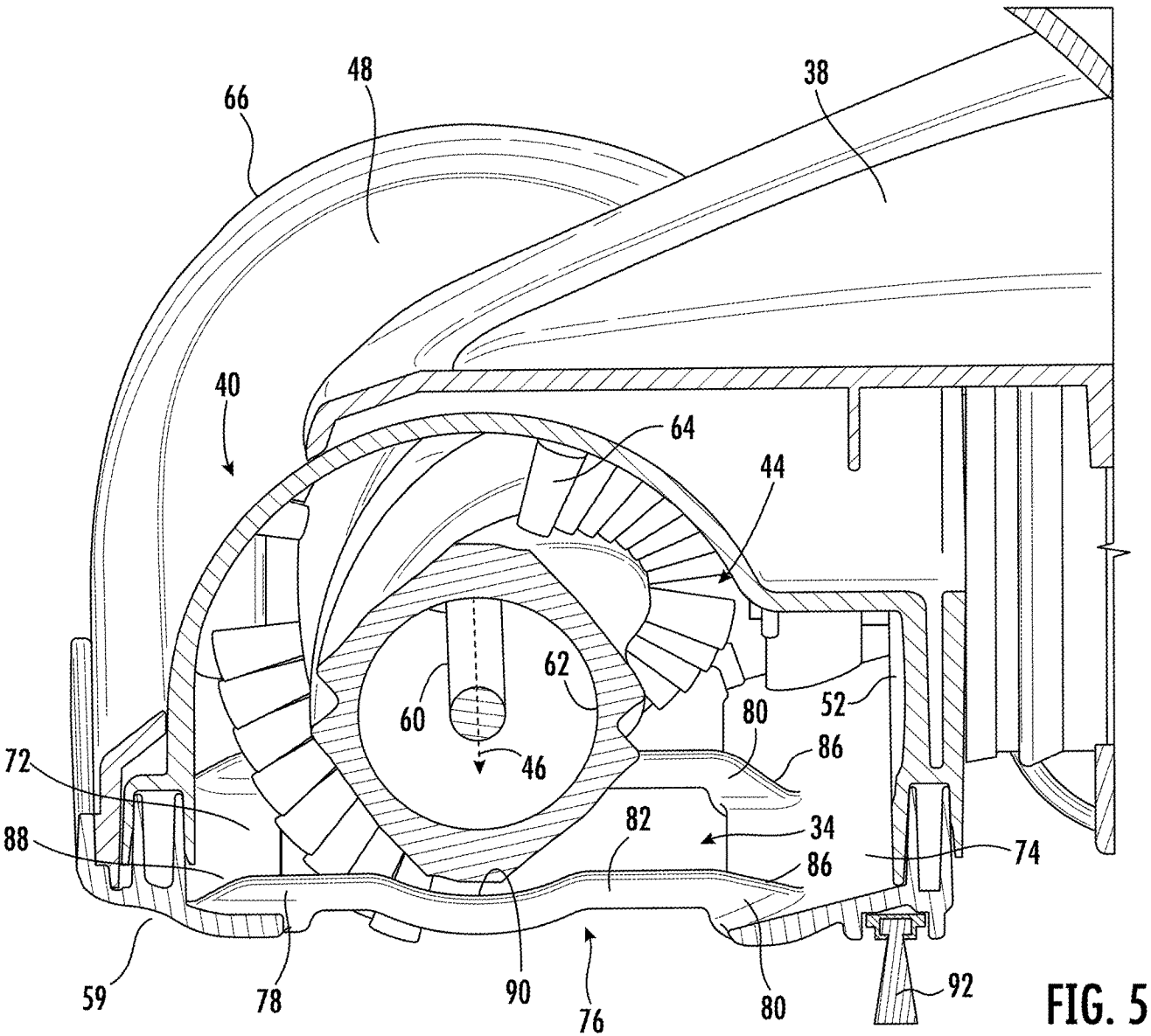
FIG. 5 is a section view taken along line 5-5 of FIG. 1.
Figure 6:
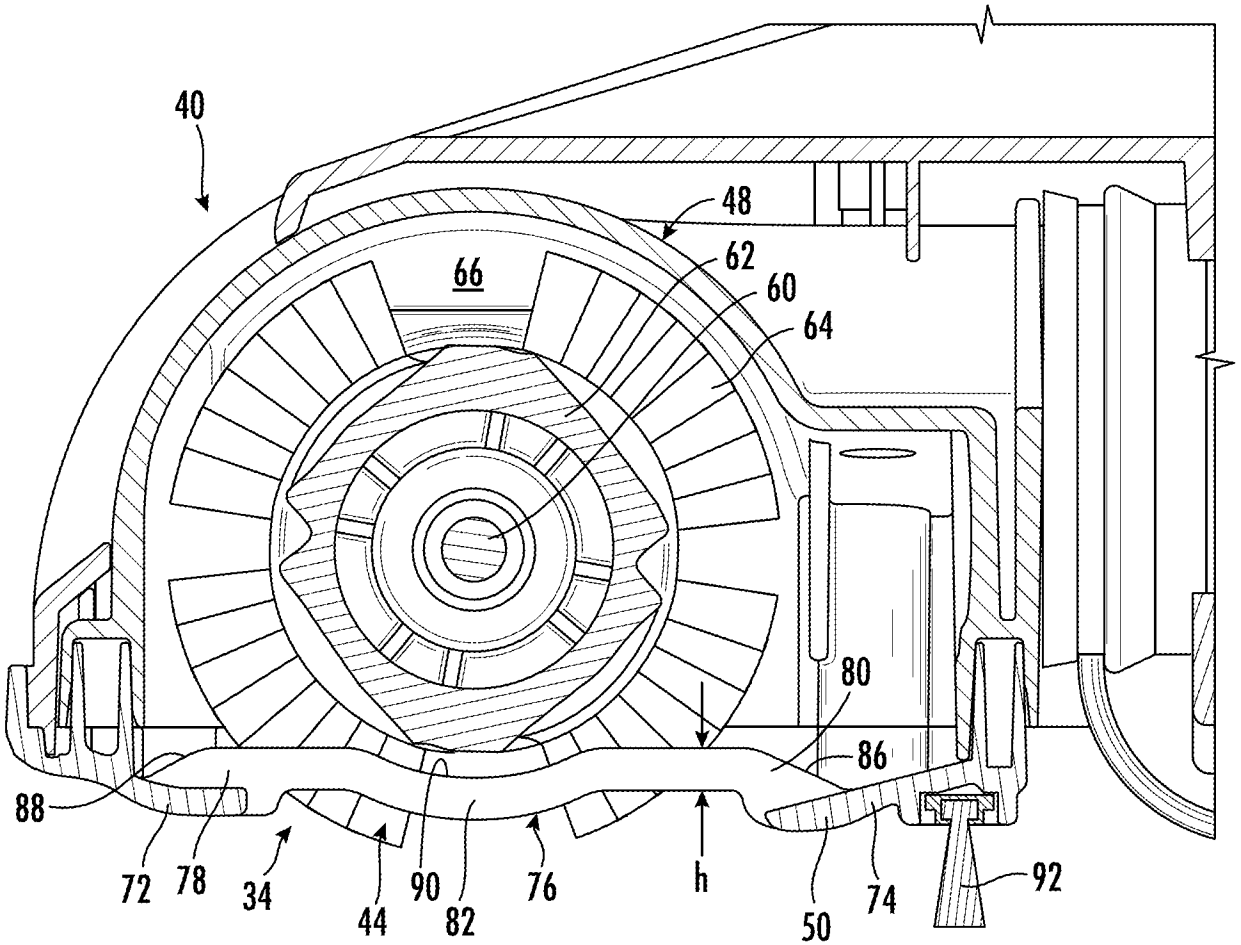
FIG. 6 is a cross-section view similar to FIG. 5.
Figure 7:
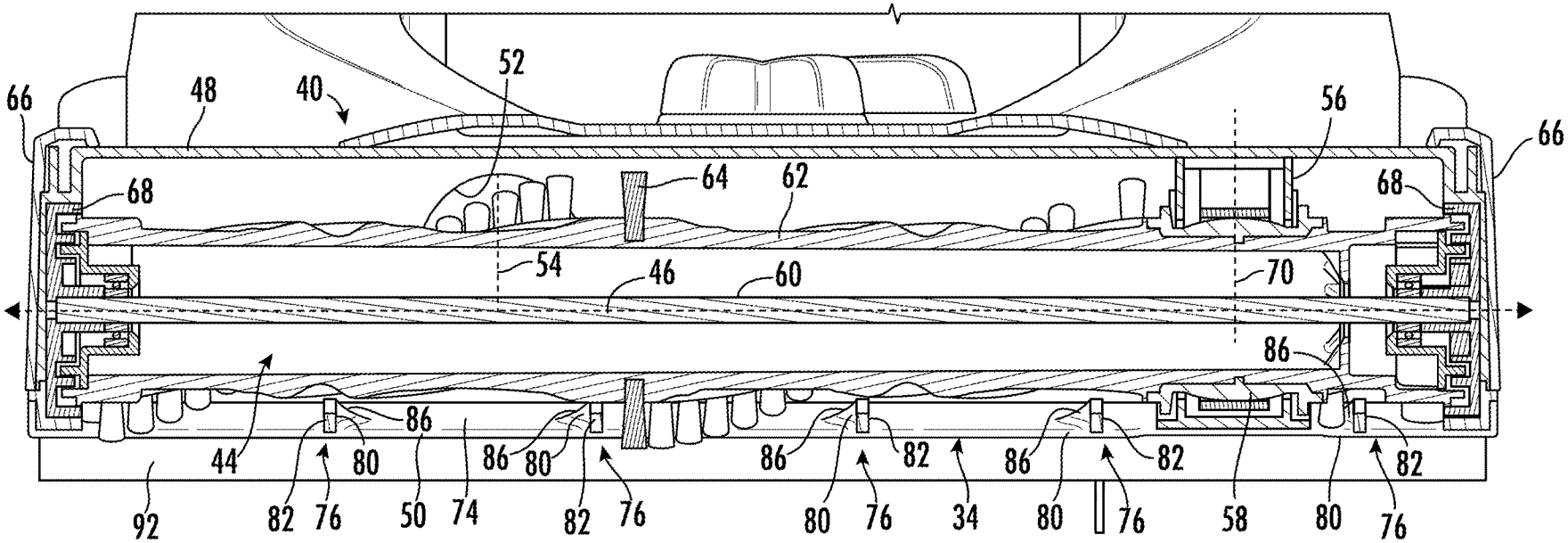
FIG. 7 is a cross-section view taken along line 7-7 of FIG. 1.

With further reference to FIGS. 5-7, the brushroll 44 includes a shaft 60, a hub 62 connected to and rotatable with the shaft 60, and bristles 64 extending radially outward from the hub 62 to agitate a surface to be cleaned during rotation of the brushroll 44. The shaft 60 is mounted to the end walls 66 of the brushroll housing 40 for rotation. In some embodiments, end caps 68 are used to support bearings that rotatably support the shaft 60. In some arrangements, the end caps 68 can be removably mounted to the end walls 66 such that the brushroll 44 can be removed from the brushroll housing 40. The brushroll 44 may also include other configurations that include vanes or microfiber fabric material in addition to or instead of the bristles 64 for agitating a surface to be cleaned.

As best shown in FIGS. 3-6, the bottom housing 50 includes a front wall 72 across the front face of the bottom housing 50 and a rear wall 74 across the rear face of the bottom housing 50. The front wall 72 is spaced apart from the rear wall 74 to define the suction inlet 34. The front and rear walls 72, 74 are arranged to slide over the surface to be cleaned. The front wall 72 (including the top surface and bottom surface) is sloped downwardly toward the suction inlet 34 and the rear wall 74 (including the top surface and bottom surface) is sloped upwardly away from the suction inlet 34. The bottom housing 50 also includes a lower portion of the belt guard 56. As shown in FIG. 6, the back lower portion of the bottom housing 50 includes a bristle strip 92 extending across the brushroll housing 40 in the axial direction to inhibit dirt and debris from being flung from the rotating brushroll 44 rearwardly of the rear wall 74 such that such dirt and debris can be drawn into the suction inlet 34. In some embodiments, the bottom housing 50 can include rollers (not shown) positioned on the front wall 72, rear wall 74, or both the front and rear walls 72, 74.

Figure 3:
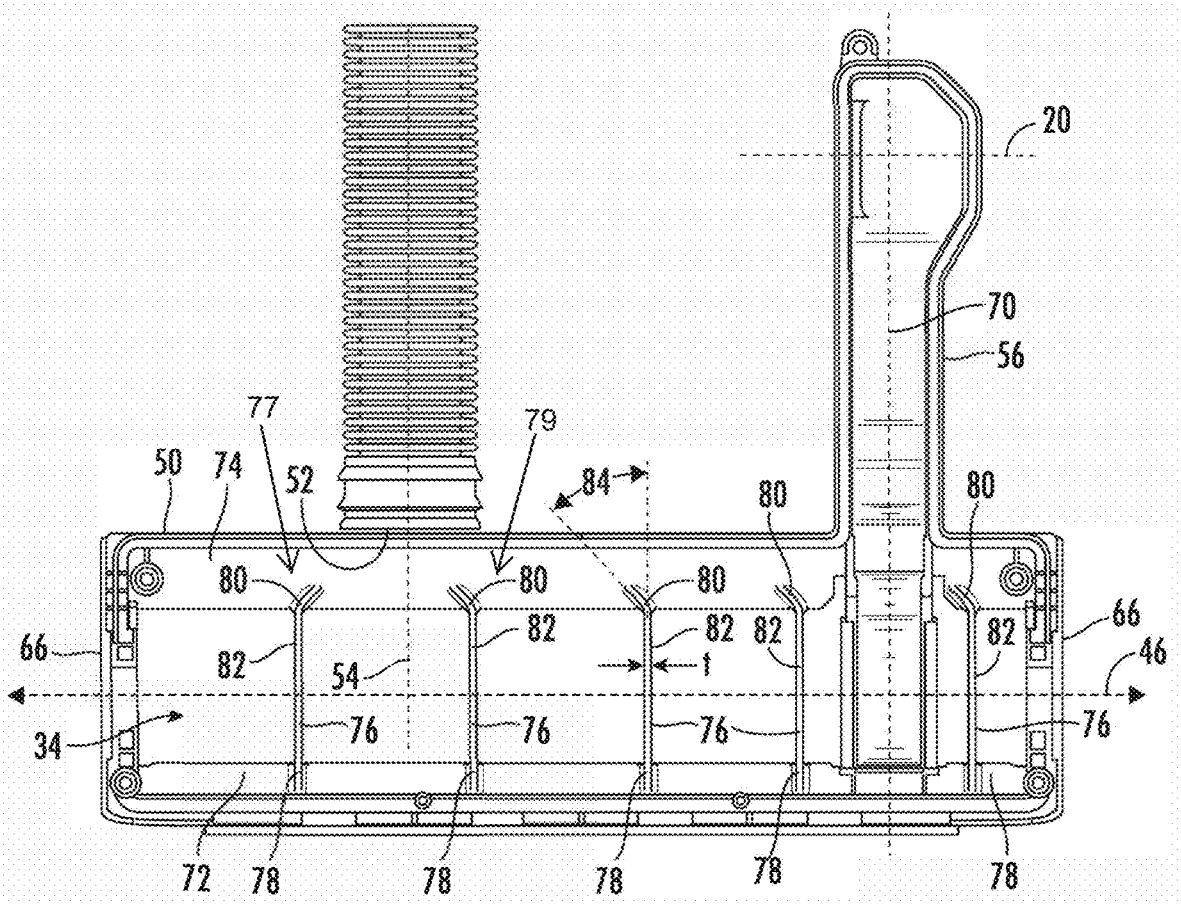
FIG. 3 is a top view of a bottom housing of a brushroll housing of the vacuum cleaner of FIG. 1.
Figure 4:
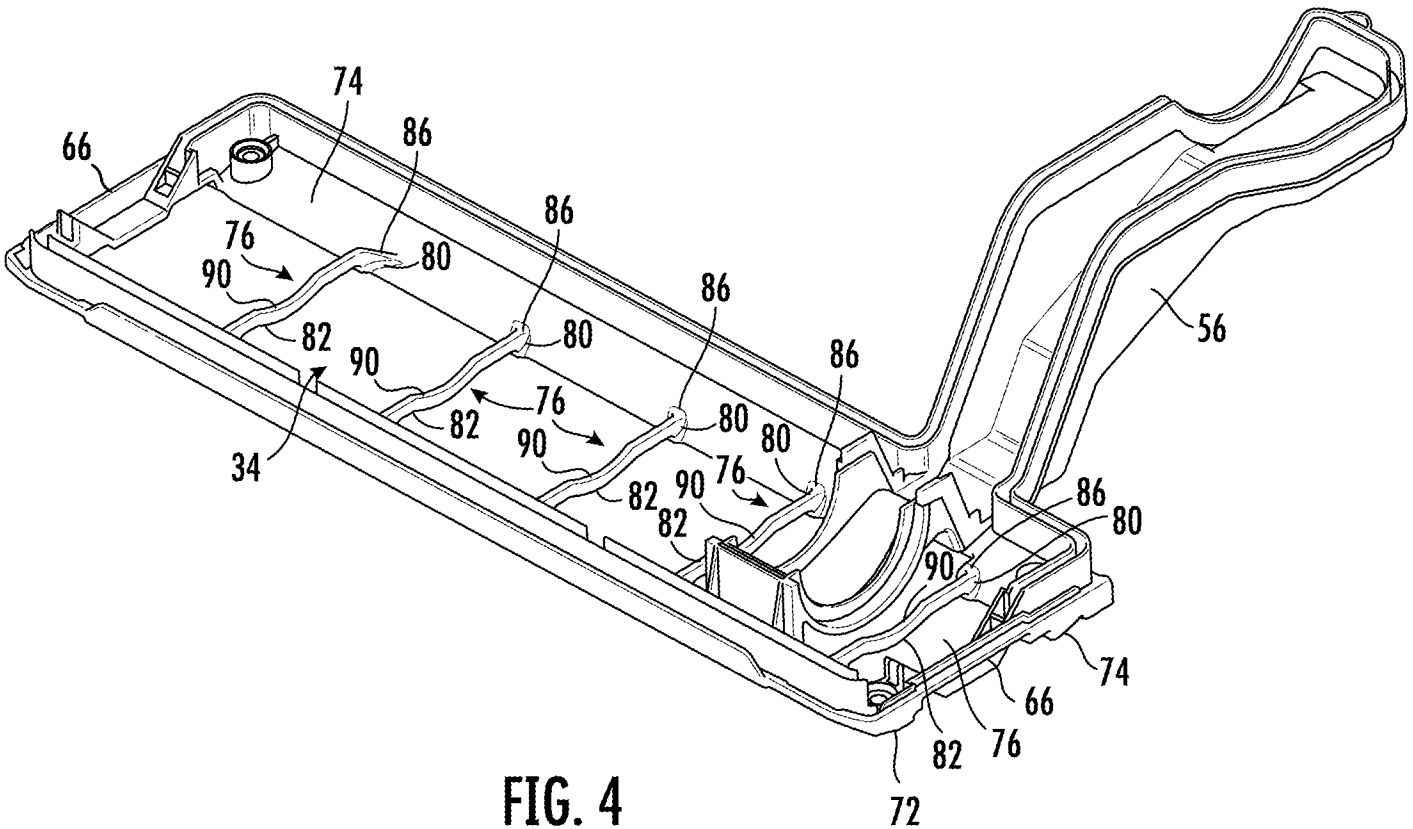
FIG. 4 is a perspective view of the bottom housing of FIG. 3.

Referring to FIG. 3, the bottom housing includes a plurality of ribs 76 located below the brushroll 44 and extending across the suction inlet between the front and rear walls 72, 74. The ribs 76 can also be referred to as "cord saver ribs" because if the surface cleaning head 12 is moved across a power cord lying on the surface to be cleaned, the spacing between the ribs 76 is sufficiently close to inhibit the cord from passing into the brushroll housing 40 far enough to wrap around the rotating brushroll 44.

Each rib 76 includes a forward portion 78 connected to the front wall 72, a rearward portion 80 connected to the rear wall 74, and a central portion 82 extending linearly orthogonal to the axial direction between the forward and rearward portions 78, 80. The rearward portion 80 is turned toward the first axial location 54 of the outlet port 52 to define a flow guide. In the illustrated embodiment, the rearward portion 80 is angled at an angle 84 relative to the central portion 82 toward the first axial location 54 of the outlet port 52 to define a flow guide. In other words, the rearward portion 80 is angled relative to the central portion 82 such that the rearward portion 80 points toward the outlet port 52. In some embodiments, the angle 84 is between 30 and 60 degrees, between 40 and 50 degrees, or about 45 degrees. The forward portion 78 is aligned with the central portion 82. In other embodiments, the rearward portion includes an arc that is curved toward the first axial location 54 of the outlet port 52 to define the flow guide Each rib 76 includes a thickness "t" measured in the axial direction and a height "h" measured in the vertical direction orthogonal to the axial direction. In some embodiments, the height h is greater than the thickness t. For example, the height h may be greater than 3 mm and the thickness may be less than 2 mm. In some embodiments, the bottom housing 50 is integrally molded as a single piece including the front wall, rear wall, ribs, and a portion of the belt guard. Each rib 76 includes a rear edge 86 that slopes downwardly from the top of the central portion 82 toward a top surface of the rear wall 74 and a front edge 88 that slopes downwardly from the top of the central portion 82 toward a top surface of the front wall 72. The rear edge 86 slopes in an opposite direction of the top surface of the rear wall 74. The front edge slopes in an opposite direction of the top surface of the front wall 72. The top surface of the central portion includes a downwardly curved portion 90 defining a recess to accommodate and prevent interference with the brushroll 44. The lower surface of the central portion 82 likewise includes a rounded edge to maintain a generally constant height h across the length of the rib 76.

With reference to FIGS. 3 and 5, the rear wall 74 of the bottom housing 50 includes a top surface that spans a distance between the suction inlet 34 adjacent its forward end and the outlet port 52 adjacent its rearward end. The rearward portion of each rib 76, which defines the flow guide, is positioned on the top surface of the rear wall 74 along this distance between the suction inlet 34 and the outlet port 52.

As best illustrated in FIG. 3, the first rib 76 (starting from left-to-right) is located to one side 77 of the first axial location and includes a rearward portion 80 angling in a first axial direction toward the outlet port 52. The second rib 76 is located to the opposite side 79 of the first axial location and includes a rearward portion 80 angling in an opposite axial direction toward the outlet port 52. The first and second ribs 76 are mirror images of each other. The third and fourth ribs 76 are configured similarly to the second rib. The fifth rib 76, also configured similarly to the second rib 76, is located on the far-right axial side of the belt guard 56 opposite to the first through fourth ribs 76. Although five ribs 76 are illustrated, four or less ribs could be used or six or more ribs could be used. In addition, although the angle 84, the thickness t, and the height h are all the same for each of the ribs 76 of the plurality, these feature dimension can vary across the ribs 76. For example, the magnitude of the angle 84 can increase or decrease in relation to the distance of the individual rib 76 from the first axial location 54.

The ribs 76 help deflect the debris into the airstream for transferring dust and debris to the working air path passing through the brushroll housing 40 to the outlet port 52. More importantly the rearward portion 80 of each rib 76 eliminates a dead air pocket that forms with straight ribs and would otherwise collect debris and prevent debris going into the working air flow path. Tables 1 and 2, provided below, illustrate the benefits of cord saver ribs 76 having turned flow guides formed by the rearward portions 80. Table 1 is test data from a configuration with straight ribs without flow guides formed by turned rearward portions, and Table 2 is test data gathered from two similar units (Unit #1 and Unit #2) configured with flow guides formed by turned rearward portions.

TABLE 1

| | | | |
|---|---|---|---|
| Nozzle Setting | Bare Floor | Debris Width | 12.2 in |
| Nozzle Width | 13.0 in | Mass of Each Debris | 5.6 g |
| Debris Area | 336.72 $in^2$ | Total Mass of Debris | 22.4 g |

Results - Unit # 1

| Run # 1 | | Run # 2 | | Run # 3 | |
|---|---|---|---|---|---|
| Initial Weight | 1363.0 g | Initial Weight | 1383.1 g | Initial Weight | 1403.4 g |
| Final Weight | 1383.1 g | Final Weight | 1403.4 g | Final Weight | 1423.8 g |
| Grams Picked Up | 20.1 g | Grams Picked Up | 20.3 g | Grams Picked Up | 20.4 g |
| Average Grams Picked Up | 20.3 g | | | | |
| Average Percent Debris Collected | 90.48% | | | | |

TABLE 2

| | | | |
|---|---|---|---|
| Nozzle Setting | Bare Floor (I) | Debris Width | 12.2 in |
| Nozzle Width | 13.0 in | Mass of Each Debris | 5.6 g |
| Debris Area | 336.72 $in^2$ | Total Mass of Debris | 22.4 g |

Results - Unit 2

| Run # 1 | | Run # 2 | | Run # 3 | |
|---|---|---|---|---|---|
| Initial Weight | 1177.8 g | Initial Weight | 1199.4 g | Initial Weight | 1220.6 g |
| Final Weight | 1199.4 g | Final Weight | 1220.6 g | Final Weight | 1242.0 g |
| Grams Picked Up | 21.6 g | Grams Picked Up | 21.2 g | Grams Picked Up | 21.4 g |
| Average Grams Picked Up | 21.4 g | | | | |
| Average Percent Debris Collected | 95.54% | | | | |

Results - Unit 3

| Run # 1 | | Run # 2 | |
|---|---|---|---|
| Initial Weight | 1177.5 g | Initial Weight | 1198.9 g |
| Final Weight | 1198.9 g | Final Weight | 1220.5 g |
| Grams Picked Up | 21.4 g | Grams Picked Up | 21.6 g |
| Average Grams Picked Up | 21.5 g | | |
| Average Percent Debris Collected | 95.98% | | |

What is claimed is:

1. A vacuum cleaner comprising:

a suction motor operable to move working air through a working air flow path from a suction inlet to a clean air outlet;

a dirt separator located along the working air flow path to separate dirt from the working air; and a surface cleaning head including a brushroll, having a body, rotatable about an axis defining an axial direction, a brushroll housing at least partially surrounding the brushroll and having an outlet port along an axial direction of the brushroll housing, and a bottom housing provided on the bottom of the brushroll housing, the bottom housing including a front wall, a rear wall spaced from the front wall to define the suction inlet, and at least one rib disposed below the brushroll body and extending across the suction inlet between the front and rear walls, wherein the at least one rib includes a forward portion connected to the front wall, a rearward portion connected to the rear wall and angled only toward the outlet port to define a flow guide, and a central portion extending orthogonal between the forward and rearward portions that connect the front and rear walls.

2. The vacuum cleaner of claim 1, wherein the at least one rib includes a thickness and a height that is greater than the thickness.

3. The vacuum cleaner of claim 2, wherein the height is greater than 3 mm.

4. The vacuum cleaner according to claim 1, wherein the rearward portion is angled between 30 and 60 degrees relative to the central portion.

5. The vacuum cleaner of claim 4, wherein the rearward portion is angled between 40 and 50 degrees.

6. The vacuum cleaner according to claim 1, further comprising a first axial location, wherein the first axial location is not centered on the brushroll housing along the axial direction.

7. The vacuum cleaner according to claim 1, wherein the rearward portion includes a rear end that slopes downwardly toward the rear wall.

8. The vacuum cleaner of claim 7, wherein the forward portion includes a front end that slopes downwardly toward the front wall.

9. The vacuum cleaner according to claim 1, wherein a top surface of the rear wall is sloped upwardly away from the suction inlet.

10. The vacuum cleaner according to claim 1, wherein a portion of a top surface of the front wall is sloped downwardly toward the suction inlet.

11. The vacuum cleaner according to claim 6, wherein the at least one rib includes a first rib located on a first axial side of the first axial location and a second rib located on a second axial side of the first axial location, wherein the second rib includes a forward portion connected to the front wall, a rearward portion connected to the rear wall and turned only toward the first axial location of the outlet port to define a flow guide.

12. The vacuum cleaner of claim 11, wherein the first and second ribs are mirror images of each other.

13. The vacuum cleaner according to claim 11, wherein the rearward portion of the first rib and the rearward portion of second rib are angled toward each other.

14. The vacuum cleaner according to claim 11, wherein the at least one rib includes a third rib located on the second axial side of the first axial location, wherein the third rib includes a forward portion connected to the front wall, a rearward portion connected to the rear wall and angled only toward the outlet port to define a flow guide.

15. The vacuum cleaner of claim 14, wherein the rearward portions of the second and third ribs are parallel.

16. The vacuum cleaner according to claim 14, wherein the surface cleaning head includes a brushroll belt positioned at a second axial location, and wherein the second and third ribs are located on opposite sides of the second axial location.

17. The vacuum cleaner according to claim 1, wherein each rib of the at least one rib includes a downwardly curved portion for accommodating the brushroll.

18. The vacuum cleaner according to claim 1, wherein the brushroll housing includes a top housing coupled to the bottom housing to at least partially surround the brushroll, wherein the outlet port is positioned along a rearward wall of the top housing.

19. The vacuum cleaner according to claim 1, wherein the bottom housing is integrally molded as a single piece including the front wall, rear wall, and the at least one rib.

20. A vacuum cleaner comprising:

a suction motor operable to move working air through a working air flow path from a suction inlet to a clean air outlet;

a dirt separator located along the working air flow path to separate dirt from the working air; and a surface cleaning head including a brushroll, having a body, rotatable about an axis defining an axial direction, and a brushroll housing at least partially surrounding the brushroll and having an outlet port along an axial direction of the brushroll housing, and a bottom housing provided on the bottom of the brushroll housing, the bottom housing including a front wall, a rear wall spaced from the front wall to define the suction inlet, and first and second ribs disposed below the brushroll body and extending across the suction inlet between the front and rear walls, wherein each of the first and second ribs includes a forward portion connected to the front wall, a rearward portion connected to the rear wall and angled only toward the outlet port to define a flow guide, and a central portion extending orthogonal between the forward and rearward portions that connect the front and rear walls, wherein the first rib is located on a first side of the axial direction of the brushroll housing and the second rib located on a second side of the axial direction of the brushroll housing.

21. The vacuum cleaner of claim 20, wherein the first and second ribs are mirror images of each other.

22. The vacuum cleaner according to claim 20, wherein the rearward portion of the first rib and the rearward portion of second rib are angled toward each other.

23. A surface cleaning head comprising: a brushroll, having a body, rotatable about an axis defining an axial direction; and a brushroll housing at least partially surrounding the brushroll and having an outlet port along an axial direction of the brushroll housing, and a bottom housing provided on the bottom of the brushroll housing, the bottom housing including a front wall, a rear wall spaced from the front wall to define the suction inlet, and a plurality of ribs disposed below the brushroll body, wherein each rib of the plurality of ribs includes a central portion extending orthogonal to the axis across a suction inlet between the front wall and the rear wall, and a flow guide angled only to direct working air toward the outlet port.

* * * * *